US008231439B2

(12) United States Patent
Dobo

(10) Patent No.: US 8,231,439 B2
(45) Date of Patent: Jul. 31, 2012

(54) BRUSH GATE ACCESSORY FOR FACETING MACHINE SPLASH PAN

(76) Inventor: Gabriel William Dobo, Leland, NC (US)

( * ) Notice: Subject to any disclaimer, the term of this patent is extended or adjusted under 35 U.S.C. 154(b) by 401 days.

(21) Appl. No.: 12/696,438

(22) Filed: Jan. 29, 2010

(65) Prior Publication Data

US 2011/0189929 A1 Aug. 4, 2011

(51) Int. Cl.
*B24B 19/00* (2006.01)

(52) U.S. Cl. ..... 451/415; 451/451; 451/455; 451/457

(58) Field of Classification Search ..... 451/415, 451/451–455, 457, 442, 445, 448, 559
See application file for complete search history.

(56) References Cited

U.S. PATENT DOCUMENTS 3,733,635 A * 5/1973 Carden ..... 15/49.1
6,994,613 B2 * 2/2006 Hacikyan ..... 451/358
8,141,197 B2 * 3/2012 Allard ..... 15/246

* cited by examiner

*Primary Examiner* — Dung Van Nguyen
(74) *Attorney, Agent, or Firm* — Shumaker, Loop & Kendrick, LLP

(57) ABSTRACT

A brush gate accessory for a faceting machine splash pan including a mounting bracket having an arcuate cross-member interconnecting first and second attachment arms, each of the first and second attachment arms defining a clip about their free for retaining the brush gate in place over a sidewall of a splash pan, and first and second opposing brushes removably attached to the first and second attachment arms, respectively, the brushes together substantially filling a space defined between the arms from the cross-member to the free ends of the arms.

15 Claims, 5 Drawing Sheets

Fig. 3
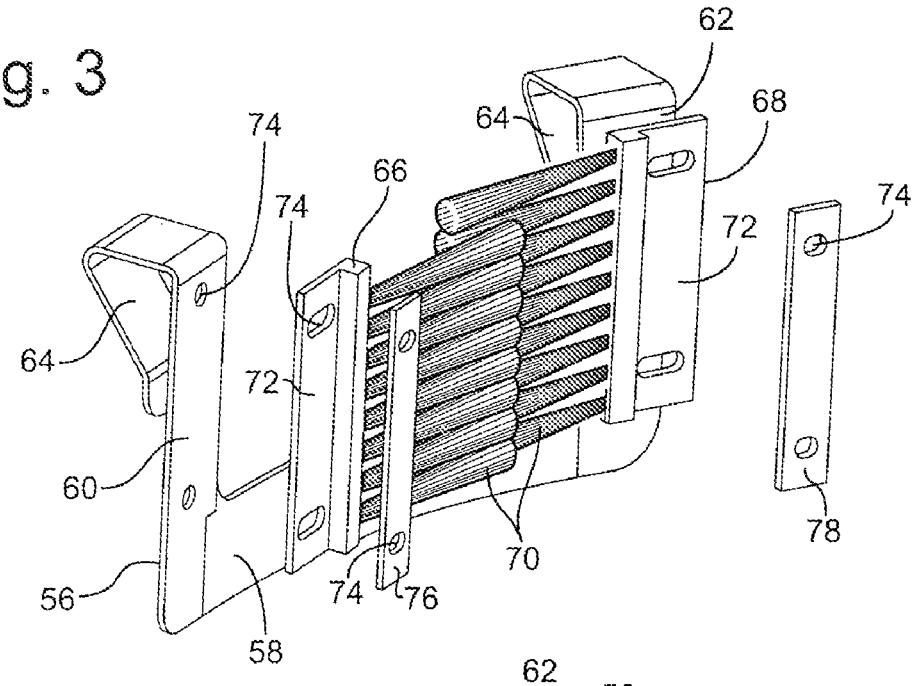
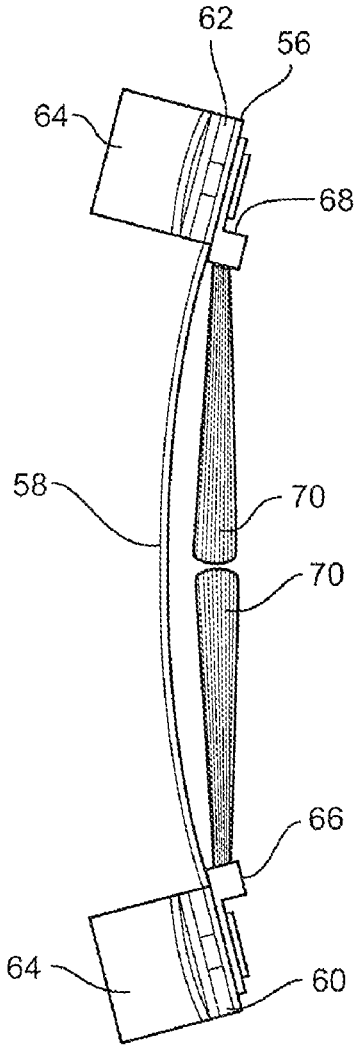
Fig. 4

BRUSH GATE ACCESSORY FOR FACETING MACHINE SPLASH PAN

TECHNICAL FIELD AND BACKGROUND OF THE INVENTION

1. Field of the Invention

The present invention relates generally to the field of faceting machine accessories, and more particularly, to a brush gate for use with a faceting machine splash pan that prevents slurry and dust from exiting the splash pan through a sidewall thereof when the dop spindle is positioned through the sidewall of the splash pan.

2. Background of the Invention

Known to those skilled in the art, faceting machines are devices that allow the user to place and polish facets onto a mineral specimen, also referred to herein as a "workpiece." Faceting machines may range in sophistication from primitive to highly-refined, and highly expensive, commercially available machines. Faceting equipment is typically divided into diamond and non-diamond capable equipment, and is further divided into industrial faceting and custom/hobby faceting equipment. Although the apparatus disclosed herein are described with particular reference to non-diamond, non-commercial equipment, it is envisioned that the principles disclosed herein may be advantageously applied to other equipment types and fields to provide the benefits described herein.

Conventionally, faceting machines in their most simple form include a mast/head assembly, lapidary disk or "lap", lap spindle, driving motor, drip assembly, and controls, among other components. To place and polish a facet onto a specimen, the specimen is attached to the dop of the head assembly, and through angle, rotation and height adjustments of the head, the specimen is lowered into contact with the lap until the desired facet has been ground. As specimen material is ground away, slurry including ground material and fluid from the drip assembly is removed from the lap by centrifugal forces generated by the spinning lap, and captured within a stationary splash pan circumferentially surrounding the lap. Captured slurry is then directed downward by the force of gravity and the shape of the splash pan through a drain and attached hose system, and is ultimately discarded.

Ideally, the splash pan has a sidewall height extending vertically beyond (i.e. "above") the working surface of the lap in order to capture slurry leaving the lap in the substantially horizontal and slightly above directions. While interference between the elevated sidewall height of the splash pan and the dop spindle is generally not an issue when faceting at lesser angles, when faceting at 90 degrees or about thereto (i.e. the dop spindle is positioned about parallel to the working surface of the lap), interference of the dop spindle and the sidewall is an issue. To accommodate this interference between components, conventional splash pans include a solid gate that is removable as needed to allow the dop spindle to "pass through" or be received "within" the splash pan. When the components are not in interfering positions, the solid gate is installed on the splash pan to close the sidewall.

Under this arrangement, the dop spindle is unable to sealingly engage the clearance in the sidewall, and thus passageway is provided between the dop spindle and non-removable portions of the sidewall for slurry and dust to escape the splash pan during faceting, which is undesirable.

Further, conventional splash pan assemblies typically include a drain positioned in the bottom of the splash pan that is attached to a drain hose through a conventional fitting. The drain hose is then routed through the device to a drain or drainage storage tank. Disadvantageously, to clean the splash pan in conventional assemblies, the user is required to first raise the splash pan upward to detach the drain hose before the splash pan can be separated from the machine. This process can be laborious and time consuming as it is difficult to access the hose fitting, and upon reinstallation of the splash pan, the hose must be redirected through the machine along its required pathway.

Accordingly, to overcome the disadvantages of the prior art faceting machine designs, it would be desirable to both provide a splash pan gate arrangement that prevents slurry from escaping the splash pan when faceting at angles in which the dop spindle and sidewall of the splash interfere, and provide a splash pan drainage arrangement that allows the user to readily remove and clean the splash pan without having to detach and reconnect a drainage hose.

BRIEF SUMMARY OF THE INVENTION

To achieve the foregoing and other aspects and advantages, in one embodiment the present invention provides a brush gate accessory for a faceting machine splash pan that allows a dop spindle to pass therethrough while preventing slurry and dust from passing therethrough. The brush gate accessory includes a mounting bracket having an arcuate cross-member interconnecting first and second attachment arms oriented perpendicular to the cross-member, each of the first and second attachment arms defining a clip about their free for retaining the brush gate in place over a sidewall of a splash pan, and first and second opposing brushes removably attached to the first and second attachment arms, respectively, the first and second opposing brushes together substantially filling a space defined between the first and second attachment arms from the cross-member to the free ends of the attachment arms.

Each of the first and second brushes include a plurality of resilient bristles substantially oriented in the same direction and secured to a common base, and the first and second attachment arms and the common base of each of the first and second brushes define at least one corresponding hole therethrough for receiving a fastener to secure the first and second brushes to the first and second attachment arms, respectively.

In a further embodiment, the brush gate accessory includes first and second plates each defining at least one opening therethrough for receiving the fastener, such that the base of the first brush is secured between the first attachment arm and the first plate, and the base of the second brush is secured between the second attachment arm and the second plate.

In another embodiment, the present invention provides a faceting machine splash pan assembly including a splash pan having an annular trough and annular sidewall extending upwardly therefrom defining a break along its length devoid of material, and a brush gate removably attached to the sidewall and spanning the break. The brush gate includes a mounting bracket having an arcuate cross-member interconnecting first and second attachment arms, each of the first and second attachment arms defining a clip about their free for retaining the brush gate in place over the sidewall, and first and second opposing brushes removably attached to the first and second attachment arms, respectively, the first and second opposing brushes together substantially filling a space defined between the first and second attachment arms from the cross-member to the free ends of the attachment arms.

Each of the first and second brushes include a plurality of resilient bristles substantially oriented in the same direction and secured to a common base, and the first and second attachment arms and the common base of each of the first and second brushes define at least one corresponding hole therethrough for receiving a fastener to secure the first and second brushes to the first and second attachment arms, respectively.

In a further embodiment, the brush gate includes first and second plates each defining at least one opening therethrough for receiving the fastener, and the base of the first brush is secured between the first attachment arm and the first plate, and the base of the second brush is secured between the second attachment arm and the second plate.

In a still further embodiment, the present invention provides a drainage assembly including a positioned through a splash pan, a funnel positioned beneath the drain for capturing slurry therein, and a drain hose removably attached to the funnel via a fitting. The funnel is mounted upon a machine base cover and includes an upper basin mounted upon a lower neck through which the hose is received therein. The upper circumferential edge of the basin has a sealing member seated thereon for providing a seal between the funnel and a bottom surface of the machine base.

In a further embodiment, the drain is received through an elongated, arcuate slot defined in the surface of the base, and the outer diameter of the basin is preferably greater than the length of the arcuate slot to permit gross alignment of the drain and funnel.

Additional features and advantages of the invention will be set forth in the detailed description which follows, and in part will be readily apparent to those skilled in the art from that description or recognized by practicing the invention as described herein.

BRIEF DESCRIPTION OF THE DRAWINGS

These and other features, aspects and advantages of the present invention are better understood when the following detailed description of the invention is read with reference to the accompanying drawings, in which:

FIG. 3 is a perspective view of the brush gate shown isolated from the faceting machine;

FIG. 4 is an overhead plan view of the brush gate of FIG. 3;

DETAILED DESCRIPTION OF THE INVENTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention.

Figure 1:
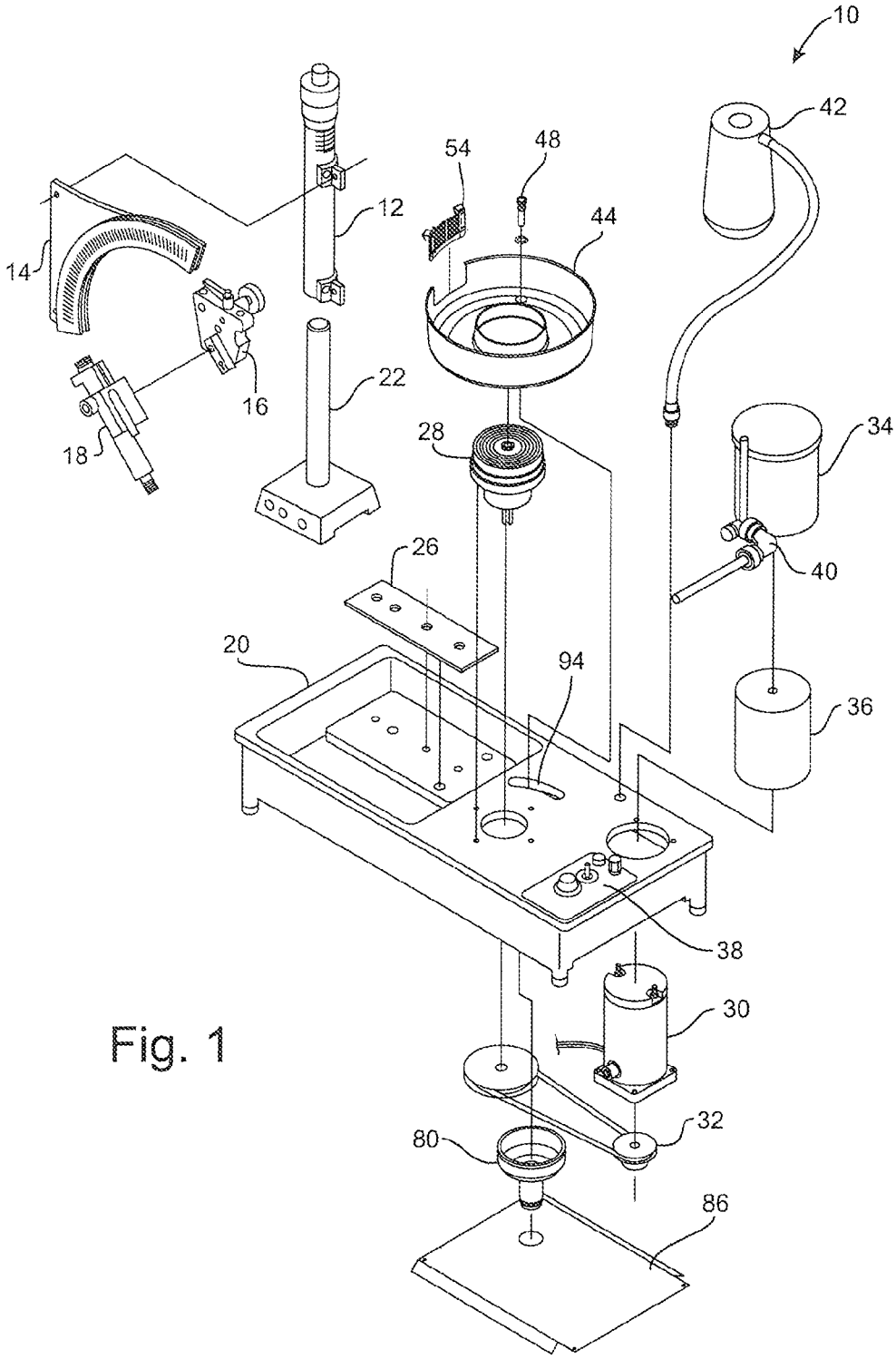
FIG. 1 is an exploded view of a faceting machine including the brush gate and drainage funnel according to embodiments of the invention.

Referring to FIG. 1, an exploded view of a faceting machine illustrating the major components thereof is shown generally at reference numeral 10. The primary component of the machine is the mast assembly, which includes a mast 12, means for angle adjustment 14, saddle block 16, and pivot body 18. The mast assembly is supported upon a machine base 20 through a mast base 22 that positions the mast generally vertically, and more importantly, perpendicularly to the lap (shown at 100 in FIG. 5) to ensure that desired facet angles are correctly placed. The mast 12 functions as the support for the means for angle adjustment 14, such as a protractor as shown, and the pivot body 18 and saddle block 16 are selectively positionable along the length of the means for angle adjustment 14 to set the angle of the facet.

Facets are placed around a specimen at the control of the pivot body 18, which is configured to rotate a dop (shown in FIG. 5 at 24) around its longitudinal axis in a stepped, repeatable and accurate manner. The dop 24 is a rod secured in the pivot body 18, typically through a quill, and the specimen is secured to the dop 24 using glue or hot wax. The mast assembly is also capable of height adjustment, and the height of the pivot body 18 relative to the lap 100 determines the depth of a facet. The mast assembly preferably includes both gross- and micro-adjustment capability. The mast assembly is connected to the machine base 20 through a mast plate 26.

The faceting machine 10 further includes a lap assembly, including a lap spindle 28 supporting a lap 100 or "grinding wheel", driving motor 30 for driving the rotation of the lap through a pulley system 32, and drip assembly including a drip can 34. The motor 30 is shown housed beneath the machine 10 and optionally includes a motor cover 36. The motor 30 is preferably velocity-variable and optionally reversible in rotation. Motor controls are provided through a control panel 38 accessibly positioned on the machine base 20. The drip assembly allows the user to set a drip rate via a spigot 40 selectively positionable over the lap 100. Fluid, such as water, from the drip can 34 is used to both cool the lap 100 to prevent stress fracturing in the stone, and to capture dust produced from grinding the specimens. The flow of water over the lap 100 captures the dust particles in a slurry, which drains into a drainage assembly described in detail below. As shown, the faceting machine 10 further includes a work light 42.

Figure 2:
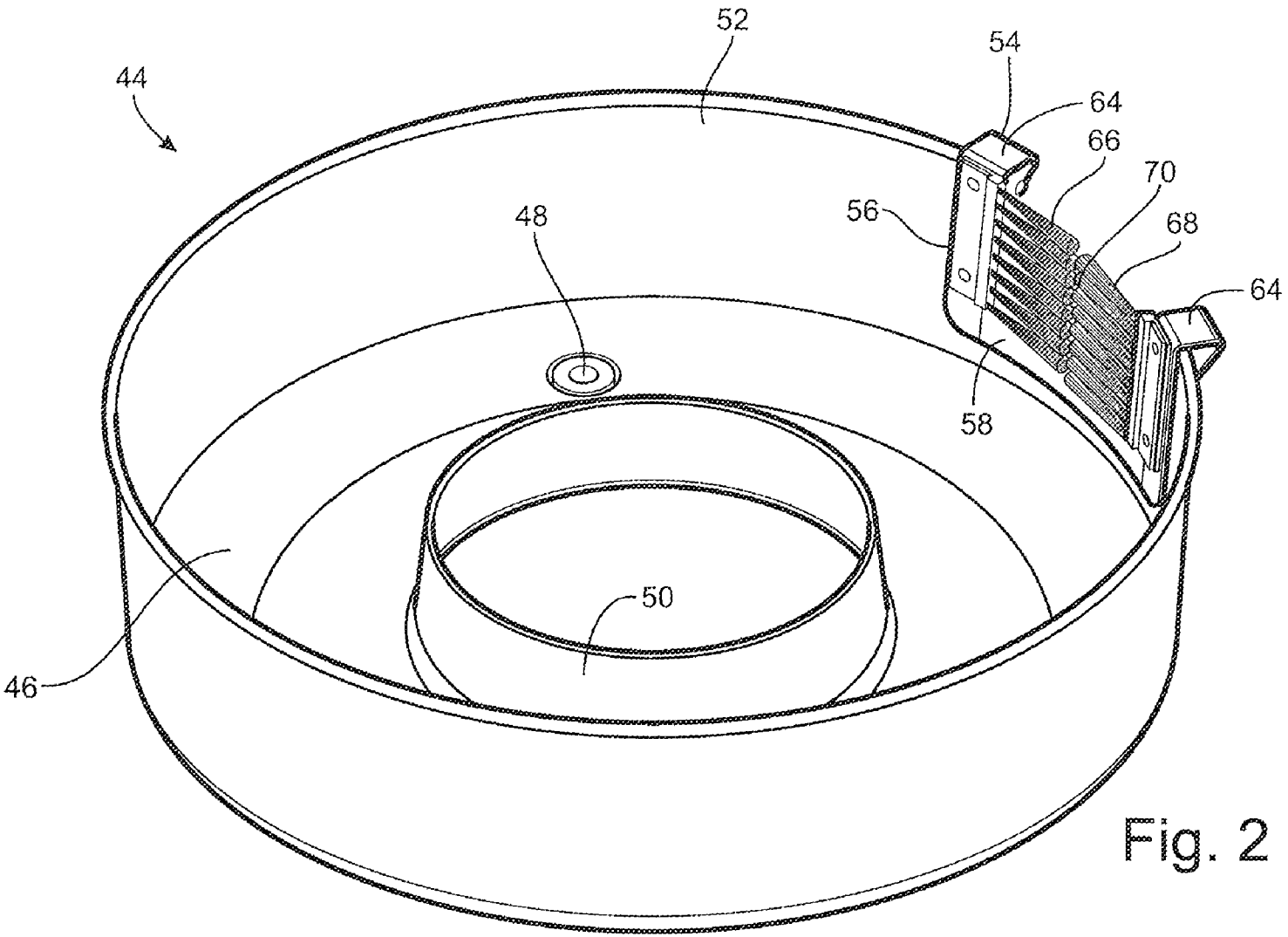
FIG. 2 is a perspective view of a splash pan shown isolated from the faceting machine and including a removable brush gate.

As slurry is produced, centrifugal forces generated by the rotating lap 100 cause the slurry to travel radially outwardly relative the rotational axis of the lap 100. The slurry is captured within a splash pan 44 that circumferentially surrounds the lap 100, as well as from beneath. Referring to FIG. 2, the splash pan 44 is essentially "doughnut-shaped" and defines an annular trough 46 positioned in the bottom for collecting the slurry and directing it to a drain 48 by its shape and/or gravitational forces. The splash pan 44 defines an annular inner wall 50 that extends generally vertically upward relative to the trough 46, and defines an opening therethrough for receiving the lap spindle 28.

Figure 5:
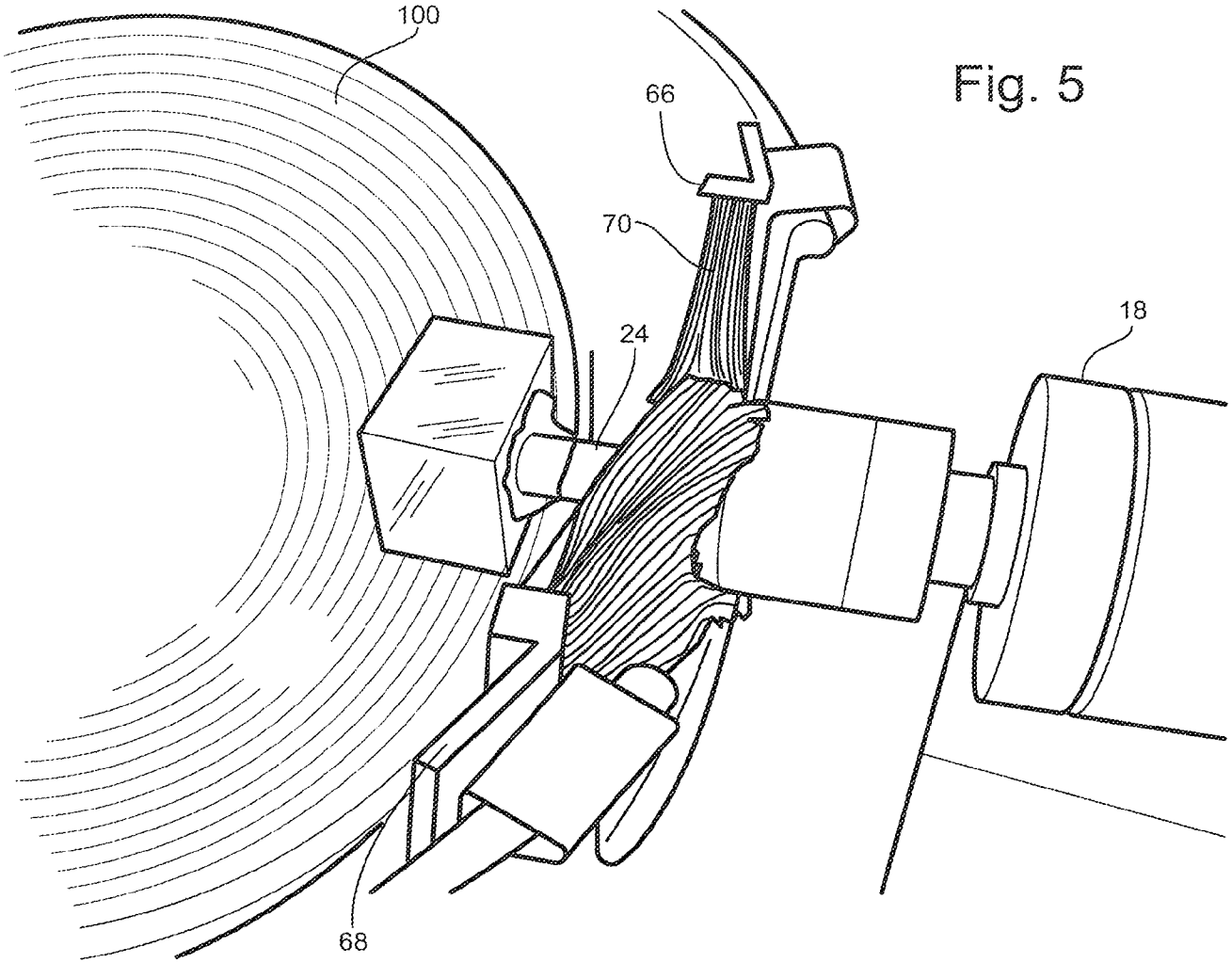
FIG. 5 is a perspective view of a portion of the faceting machine showing the brush gate in use.

The splash pan 44 further defines an annular sidewall 52 extending generally vertically upward from the trough 46, and preferably beyond (i.e. above) the height of the working surface of the lap 100 such that slurry directed horizontally from the lap and slightly above is prevented from escaping the sidewall 52. The height of the sidewall 52 is thus also greater than the height of the inner wall 50. The sidewall 52 defines an opening or a "break" in the sidewall along its length devoid of material through which the dop 24, and possibly a portion of the pivot body 18, can pass through when the pivot body 18 is oriented at certain angles with respect to the working surface of the lap 100. For example, an angle at which the dop 24 may interfere with the sidewall 52 is at about 90 degrees, or as a longitudinal axis of the pivot body 18 approaches parallel orientation with the working surface of the lap 100, as illustrated in FIG. 5. To accommodate this interfering angle, the break in the sidewall 52 allows the dop 24 to pass through the sidewall 52.

In conventional assemblies, the shape of the opening in the sidewall 52 and the shape of the dop 24 do not correspond, thus openings are provided between the edges of the sidewall break and the dop 24 that allow slurry to escape therethrough. To effectively close and seal off the sidewall 52 when the dop 24 is in the "interfering" orientation passing through the sidewall 52, a brush gate accessory 54 is provided.

Referring to FIGS. 2-4, the brush gate 54 is mounted within the break in the sidewall 52 and effectively fills or blocks the opening while allowing the dop 24 to pass therethrough. Structurally, the brush gate 54 includes a mounting bracket 56 having an arcuate cross-member 58 interconnecting first and second attachment arms 60, 62, each of the first and second attachment arms 60, 62 defining a clip 64 about their free for retaining the brush gate 54 in place over the sidewall 52 of the splash pan 44 at the edges of the break in the splash pan 44. The brush gate 54 further includes first and second opposing brushes 66, 68 removably attached to the first and second attachment arms 60, 62, respectively. The opposing brushes 66, 68 together substantially fill the space defined between the first and second attachment arms 60, 62 from the cross-member 58 to the free ends of the attachment arms.

The first and second brushes 66, 68 include a plurality of resilient bristles 70 substantially oriented in the same direction and secured to a common base 72. The first and second attachment arms 60, 62 and the common base 72 of each of the first and second brushes 66, 68 define at least one corresponding hole 74 therethrough for receiving a fastener to secure the brushes to the attachment arms. The brush gate 54 further includes first and second plates 76, 78 each defining at least one hole 74 therethrough for receiving the fastener. The base 72 of the first brush 66 is secured between the first attachment arm 60 and the first plate 76, and the base 72 of the second brush 68 is secured between the second attachment arm 62 and the second plate 78. Thus, the holes defined through the attachment arms, bases and plates are aligned and receive a fastener therethrough to secure the components together. In a specific embodiment, the first and second attachment arms 60, 62 are oriented generally perpendicular to the cross-member 58, and the arcuate shape of the cross-member follows the arcuate shape of the splash pan sidewall 52. The bristles 70 may or may not closely follow the arcuate shape of the sidewall 52.

Figure 7:
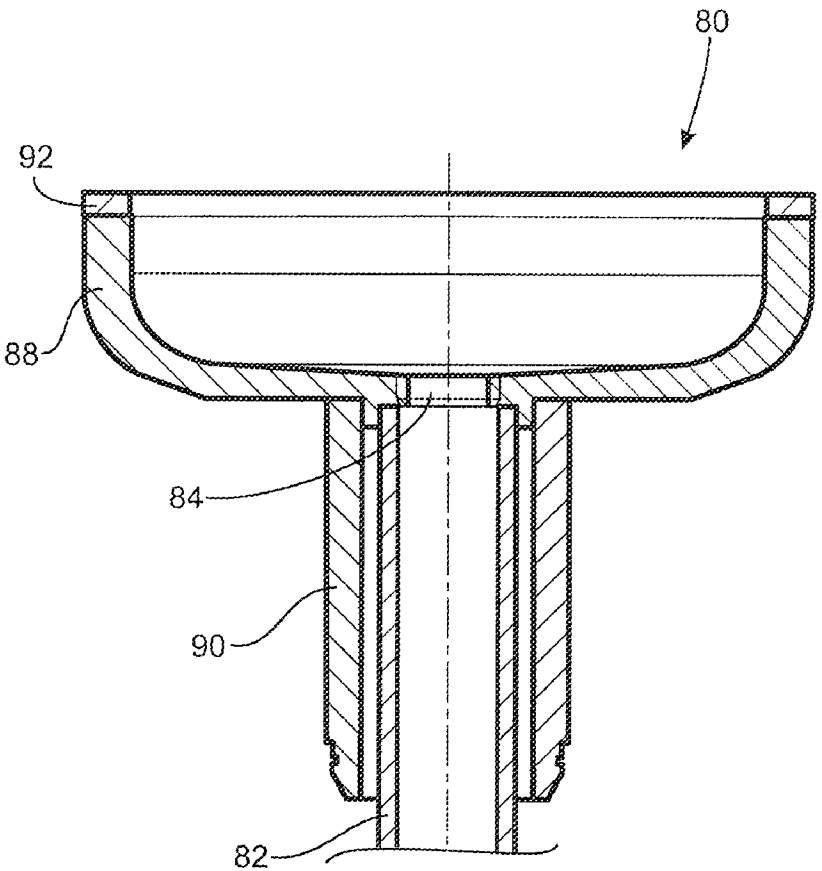
FIG. 7 is a cross-sectional view of the drainage funnel of FIG. 6 including a connected drainage hose and hose fitting.
Figure 6:
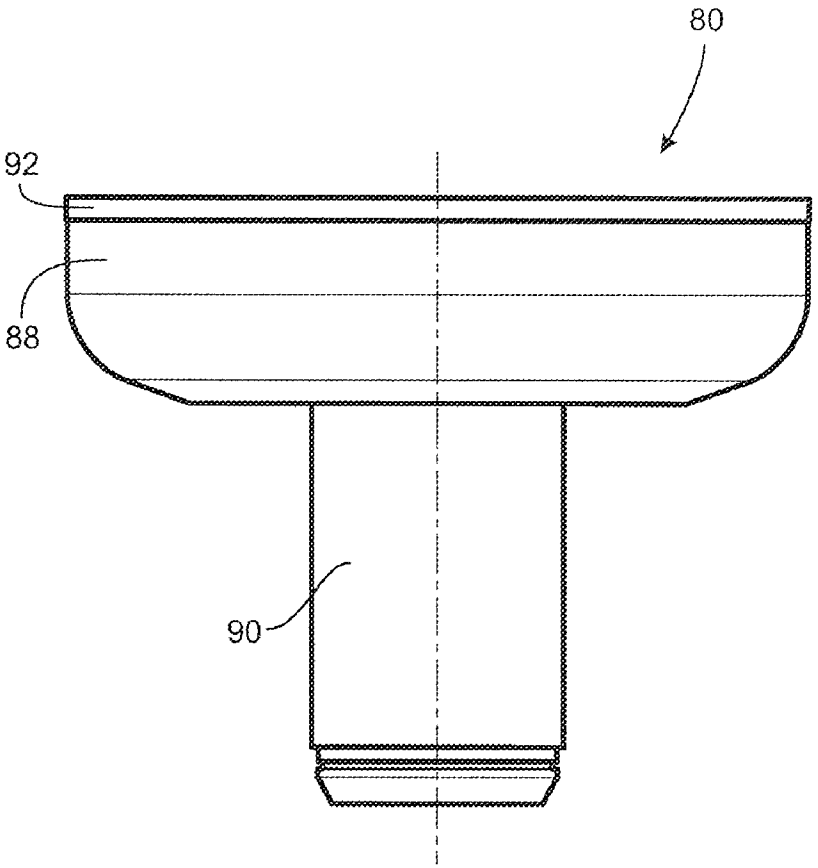
FIG. 6 is a side elevation view of the drainage funnel.

Referring to FIGS. 2, 6 and 7, the faceting machine 10 further includes a drainage assembly including the drain 48 positioned through the trough of the splash pan 44, a funnel 80 positioned beneath the drain 48 for capturing the slurry from the drain 48, and a drain hose 82 removably attached to the funnel 80 via a fitting 84. This assembly is advantageous as compared to conventional assemblies including a hose directly connected to the drain, requiring the hose to be disconnected to remove the splash pan 44 from the machine 10 for cleaning. The funnel 80 is mounted upon a machine base cover 86 and includes an upper basin 88 mounted upon a lower neck 90 through which the hose 82 is received therein and is removably attached via the fitting 84. The upper circumferential edge of the basin 88 has a sealing member 92, such as a gasket, seated thereon that, when installed on the faceting machine 10, provides a seal between the funnel 80 and a bottom surface of the machine base 20.

As shown in FIG. 2, the drain 48 is received through an elongated, arcuate slot 94 defined in the surface of the base 20. The outer diameter of the basin portion of the funnel 80 is preferably sized greater than the length of the arcuate slot 94 in order to capture slurry directed from the drain and/or the top surface of the machine base 20. Thus, the funnel basin 88 is "oversized" relative to the diameter of the drain 48. This also advantageously allows for gross alignment of the drain 48 and funnel 80, ensuring that slurry from the drain will be captured within the funnel 80 in the components are not exactly aligned. A mechanical disconnect between the drain 48 and hose 82, in contrast to conventional assemblies, also allows for ready removal of the splash pan 44 and obviates the need for handling the drain hose 82 when the splash pan 44 is removed from the machine 10, such as for cleaning.

Each of the brush gate 54 and funnel 80 accessories described herein may be installed as original equipment for purchase with a faceting machine, may be sold as a component of a greater assembly, or may be sold by themselves as accessories. In one example, the splash pan, drain, brush gate, funnel including the fitting, and drain hose may be sold as a kit.

While a faceting machine and various accessories have been described herein with reference to specific embodiments and examples, it is envisioned that various details of the invention may be changed without departing from the scope of the invention. Furthermore, the foregoing description of the preferred embodiments of the invention and best mode for practicing the invention are provided for the purpose of illustration only and not for the purpose of limitation.

What is claimed is:

1. A brush gate accessory for a faceting machine splash pan, comprising:

a mounting bracket including an arcuate cross-member interconnecting first and second attachment arms, each of the first and second attachment arms defining a clip about their free for retaining the brush gate in place over a sidewall of a splash pan; and first and second opposing brushes removably attached to the first and second attachment arms, respectively, the first and second opposing brushes together substantially filling a space defined between the first and second attachment arms from the cross-member to the free ends of the attachment arms.

2. The brush gate accessory according to claim 1, wherein each of the first and second brushes include a plurality of bristles substantially oriented in the same direction and secured to a common base.

3. The brush gate accessory according to claim 2, wherein the first and second attachment arms and the common base of each of the first and second brushes define at least one corresponding hole therethrough for receiving a fastener to secure the first and second brushes to the first and second attachment arms, respectively.

4. The brush gate accessory according to claim 3, further comprising first and second plates each defining at least one hole therethrough for receiving the fastener.

5. The brush gate accessory according to claim 4, wherein the base of the first brush is secured between the first attachment arm and the first plate, and the base of the second brush is secured between the second attachment arm and the second plate.

6. The brush gate accessory according to claim 2, wherein the plurality of bristles are resilient.

7. The brush gate accessory according to claim 1, wherein the first and second attachment arms are oriented generally perpendicular to the cross-member.

8. The brush gate accessory according to claim 1, wherein the brush gate accessory spans a void in a sidewall of a splash pan that receives a dop spindle therethrough.

9. A faceting machine splash pan assembly, comprising:

a splash pan including an annular trough and an annular sidewall extending upwardly therefrom, the sidewall defining a break along its length devoid of material; and a brush gate removably attached to the sidewall and spanning the break, the brush gate comprising a mounting bracket including an arcuate cross-member interconnecting first and second attachment arms, each of the first and second attachment arms defining a clip about their free for retaining the brush gate in place over the sidewall, and first and second opposing brushes removably attached to the first and second attachment arms, respectively, the first and second opposing brushes together substantially filling a space defined between the first and second attachment arms from the cross-member to the free ends of the attachment arms.

10. The assembly according to claim 9, wherein each of the first and second brushes include a plurality of resilient bristles substantially oriented in the same direction and secured to a common base.

11. The assembly according to claim 10, wherein the first and second attachment arms and the common base of each of the first and second brushes define at least one corresponding hole therethrough for receiving a fastener to secure the first and second brushes to the first and second attachment arms, respectively.

12. The assembly according to claim 11, wherein the brush gate further comprises first and second plates each defining at least one hole therethrough for receiving the fastener.

13. The assembly according to claim 12, wherein the base of the first brush is secured between the first attachment arm and the first plate, and the base of the second brush is secured between the second attachment arm and the second plate.

14. The assembly according to claim 9, wherein the first and second attachment arms are oriented generally perpendicular to the cross-member.

15. The assembly according to claim 9, wherein the splash pan further comprises a drain disposed through the trough.

* * * * *